United States Patent [19]

Mochida

[11] Patent Number: 4,620,763

[45] Date of Patent: Nov. 4, 1986

[54] CONNECTOR APPARATUS FOR CONNECTING HIGH-TENSION CABLE

[75] Inventor: Hideyuki Mochida, Yokosuka, Japan

[73] Assignee: Hitachi, Ltd., Tokyo, Japan

[21] Appl. No.: 576,907

[22] Filed: Feb. 3, 1984

[30] Foreign Application Priority Data

Feb. 4, 1983 [JP] Japan ..... 58-14331[U]

[51] Int. Cl.[4] ..... H01R 4/00

[52] U.S. Cl. ..... 339/94 R; 339/256 S

[58] Field of Search ..... 339/94, 59, 60, 61, 339/201, 211-213, 256 S, 147 P, 275 T, 275 R, 89 R

[56] References Cited

U.S. PATENT DOCUMENTS

| | | | |
|---|---|---|---|
| 2,958,844 | 1/1960 | Smith et al. | 339/213 R |
| 3,334,326 | 1/1967 | Besore et al. | 339/94 C |
| 3,550,064 | 12/1970 | Caller et al. | 339/275 T |
| 3,775,828 | 12/1973 | Kopenhaver | 339/89 R |
| 3,824,526 | 7/1974 | Glover | 339/94 R |
| 3,902,779 | 9/1975 | Herbert | 339/256 S |
| 3,994,553 | 11/1976 | Kornick | 339/211 |
| 4,123,131 | 10/1978 | Pearce, Jr. et al. | 339/213 R |
| 4,192,567 | 3/1980 | Gomolka | 339/256 S |
| 4,193,655 | 3/1980 | Herrmann, Jr. | 339/94 M |
| 4,274,695 | 6/1981 | Fukumori et al. | 339/147 P |
| 4,312,553 | 1/1982 | Lychesjo | 339/94 M |
| 4,387,947 | 6/1983 | Lostumo et al. | 339/94 R |

*Primary Examiner*—Gil Weidenfeld
*Assistant Examiner*—David L. Pirlot
*Attorney, Agent, or Firm*—Antonelli, Terry & Wands

[57] ABSTRACT

A connector apparatus for connecting a high tension cable carrying a large current to a device to be supplied with the current or a load device. The connector apparatus comprises a tubular isolating wall of an insulating resin, a cylindrical packing disposed so as to enclose the high tension cable and placed within the tubular isolating wall under a pressure, and a coil-like contact supported by the tubular isolating wall and brought into electrical contact with a contact of the high tension cable. The packing has an outer wall formed with a plurality of ridges which are intimately contacted with the inner surface of the tubular isolating wall. The coil-like contact has a cylindrical portion in which the contact of the high tension cable is placed, a coiled spring portion which is contiguous to the cylindrical portion, and a terminal portion contiguous to the coiled spring portion.

2 Claims, 6 Drawing Figures

CONNECTOR APPARATUS FOR CONNECTING HIGH-TENSION CABLE

BACKGROUND OF THE INVENTION

The present invention generally to an electrical connector apparatus, and, more particularly, to a connector apparatus for connecting a cable through which a current flows under a high voltge to a current utilizing device, load device or the like.

The present-day television (TV) receiver, inclusive of a projection type TV receiver, incorporates a high-tension current generating apparatus for supplying a current under a high voltage to a cathode ray tube (CRT) used in the receiver. The high tension current generator is composed of a flyback transformer which is capable of producing a voltage in a range of 10 to 30 kV, wherein the electric current is supplied to the cathode ray tube from the flyback transformer by a cable interconnecting the flyback transformer and the cathode ray tube. A connector device for connecting the flyback transformer and the cathode ray tube is known. However, a disadvantage of the known connector device resides in the fact that when subjected to vibration the connection often becomes loose.

An object of the present invention is to provide a connector apparatus in which electric discharge (arc) is unlikely to take place, and in particular a connector apparatus having a structure in which aqueous vapor or steam is prevented from entering the interior of the tubular isolating wall.

It is another object of the present invention to provide a connector apparatus in which electric connection of the two contacts can be positively assured.

DETAILED DESCRIPTION

Figure 1:
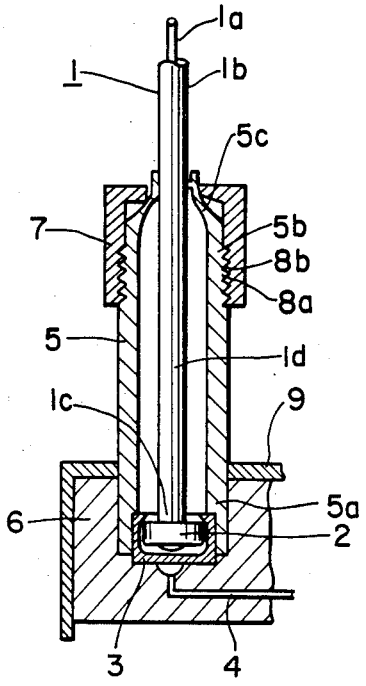
FIG.1 PRIOR ART
FIG. 1 is a partially sectional view of a known connector apparatus.

Referring now to the drawings wherein like reference numerals are used throughout the various views to designate like parts and, more particularly, to FIG. 1, according to this figure, a prior art high tension connector apparatus includes a cable generally designated by the reference numeral 1 having a conductor 1*a* and an insulating coat 1*b*, wherein the conductor 1*a* is disposed at a center of the insulating coat 1*b*. The cable 1 has an end portion 1*c* to which a contact 2 is connected. The contact 2 is thus electrically connected to the conductor 1*a* and is engaged in a female or socket contact 3, the latter being connected to a conductor 4 which, in turn, is connected to the fly back transformer (not shown). A tubular elongate isolating or insulating wall 5 surrounds a portion 1*d* of the cable 1, with the isolating or insulating wall 5 being formed of a plastic material and having an end portion 5*a* inserted through a hole formed in a case 9 and disposed therein. The end portion 5*a* serves to hold the female contact 3 by an inner wall thereof, with an interior of the case 9 being filled with an insulating resin such as, for example, an epoxy resin. The isolating or insulating wall 5 has a thin walled end portion 5*c* and a portion 5*b* having an external surface formed with a male thread 8*a*. A cap 7 is positioed on the portion 5*b* and has an inner surface formed with a female thread 8*b* adapted to be engaged by the male thread 8*a*. a hole for accommodating the cable 1 is formed in the top of the cap 7, and when the cap 7 is secured to the isolating wall 5, the end portion 5*c* of the wall 5 is interposed between the cap 7 of the cable 1.

In the structure of FIG. 1, a slot is usually formed in the end portion 5*c* resulting in a gap or clearance being produced between the end portion 5*c* of the wall 5 and the cable 1. When humidity in the air increases, aquaeous vapor or steam will flow into the interior of the wall 5 through the gap and be deposited on the inner surface of the wall 5 as well as the surface of the portion 1*b* of the cable 1. Consequently, an electric discharge from the contact 3 by way of the inner surface of the wall 5 and the surface of the cable 1 and, hence along the outer surfaces of the cap 7, wall 5, and case 9 can occur. Additionally, the contacts 2, 3 of the connector apparatus of FIG. 1 are not always positively coupled but merely fitted to each other and, thus, upon the connector apparatus being subjected to vibration, the connection often becomes broken.

Figure 2:
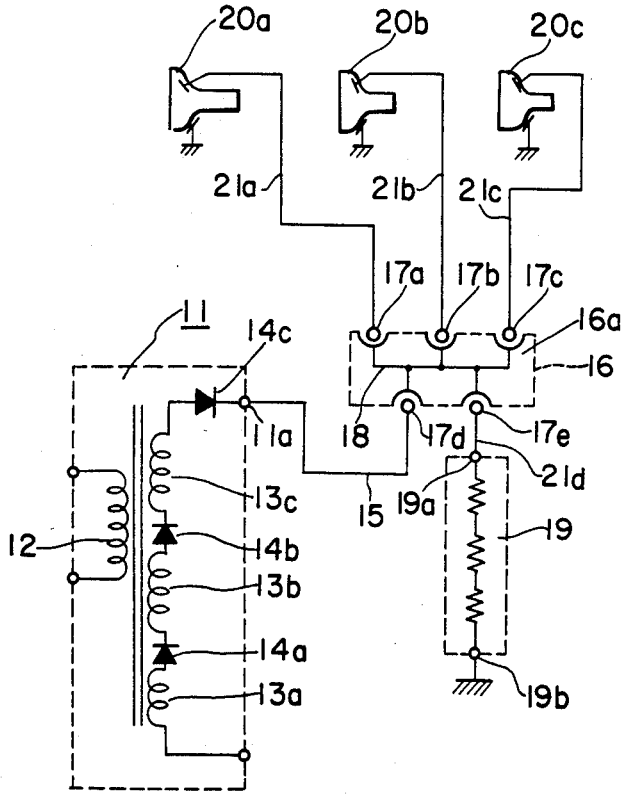
FIG. 2 is a circuit diagram of a high tension current supply apparatus used in a television receiver of projection type.
Figure 3:
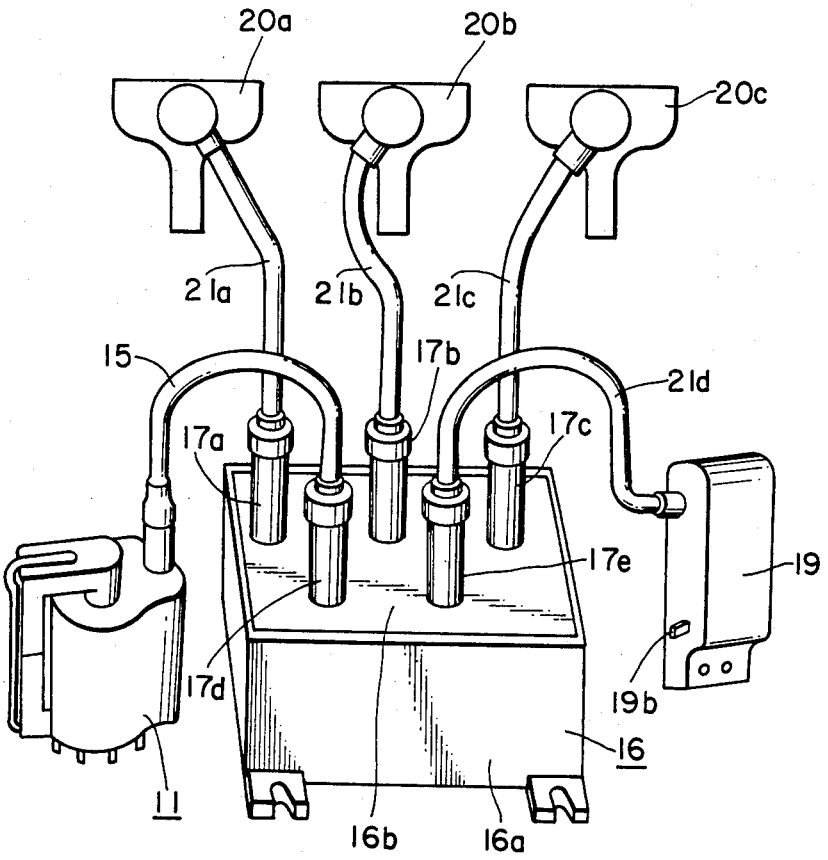
FIG. 3 is a perspective view of a high tension current supply apparatus in which connector apparatus according to the invention are used.
Figure 4:
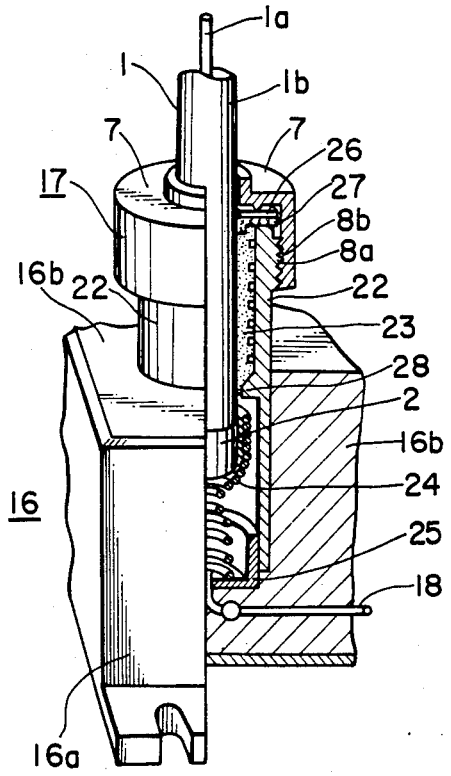
FIG. 4 is a perspective view showing a main part of the apparatus shown in FIG. 3 with a portion being broken away.

As shown in FIG. 2, a flyback transformer 11 includes a primary winding 12, a plurality of secondary windings 13*a*, 13*b* and 13*c* and diodes 14*a*, 14*b* and 14*c* connected in series to the secondary windings 13*a*, 13*b* and 13*c*, respectively. The current produced under high voltage by the flyback transformer 11 is supplied from a terminal 11*a* to a current distributor 16 by a cable 15 connected to the terminal 11*a*. The cable 15 and an inner conductor 18 of the current distributor 16 are connected to each other by a connector apparatus or device 17*d*. Further, the conductor 18 is connected to connector devices 17*a*, 17*b*, 17*c* and 17*e*, whereby the current fed through the cable 15 is distributed to the connector devices 17*a*, 17*b*, 17*c* and 17*e*. Cables 21*a*, 21*b* and 21*c* are connected to the connector devices 17*a*, 17*b* and 17*c*, respectively, and supply high tension currents to cathode ray tubes 20*a*, 20*b* and 20*c*, respectively. The cathode ray tubes 20*a*, 20*b* and 20*c* produce, for example, light in red, green and blue, respectively. A cable 21*d* is connected to the connector device 17*e* and hence to a resistor 19 at a terminal 19*a* thereof. The other terminal 19*b* of the resistor 19 is coupled to a common potential (ground potential). The interior of a case (housing) 16*a* of the current distributor 16 is filled with an insulating resin such as, for example, epoxy resin. In case the current distributor 16 is used in a general type television receiver, the connector devices 17*b*, 17*c* are unnecessary and, are not provided in the distributor 16. As shown in FIG. 4, connector device or apparatus 17 includes an insulating tube, i.e. tubular isolating wall 22 formed of an insulating resin, a packing (plug) 23 formed of an insulating resin in a cylindrical configuration, a metallic contact 24 in a coil-like form (also referred to as the coiled contact), a stopper 25 made of a metal, a washer 26 formed of a plastic material and a cap 7 also of a plastic material. The packing 23 is bonded to an insulating coat 1*b* of the cable 1 by a bonding agent 27. The washer 26 is bonded to the packing 23 by the bonding agent 27. The coiled contact 24 is connected to the conductor 18 and is in electrical contact with a contact 2 which is realized in a cap-like configuration and placed on the insulating coat 1*b*. The contact 2 has an inner diameter which is substantially equal to the outer diameter of the insulating coat 1*b*. The contact 2 is electrically connected to the conductor 1*a* of the cable 1. The stopper 25 has an outer diameter, which is substantially equal to the inner diameter of the insulating tube 22 so that the stopper 25 can be retained by the insulating tube (also referred to as the tubular isolating wall) 22. The cap 7 has an inner wall formed with a female thread 8*b* which is adapted to be engaged by a male thread 8*a* formed in the insulating tube 22. A tapered rib 28, in abutment with the end portion of the packing is formed in the inner wall of the insulating tube 22.

Figure 5:
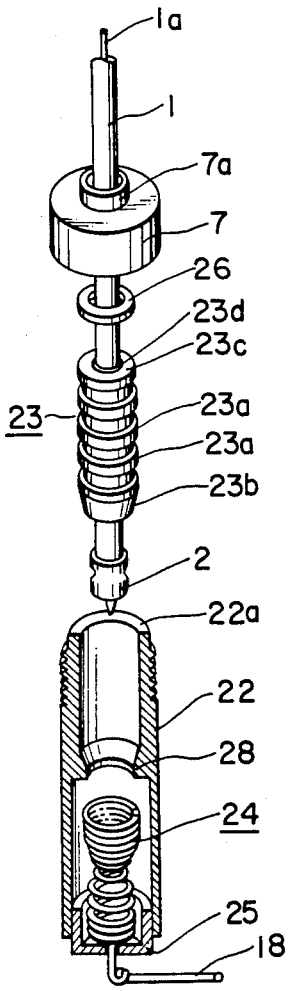
FIGS. 5 and 6 are exploded perspective views of the connector apparatus according to an embodiment of the present invention.
Figure 6:
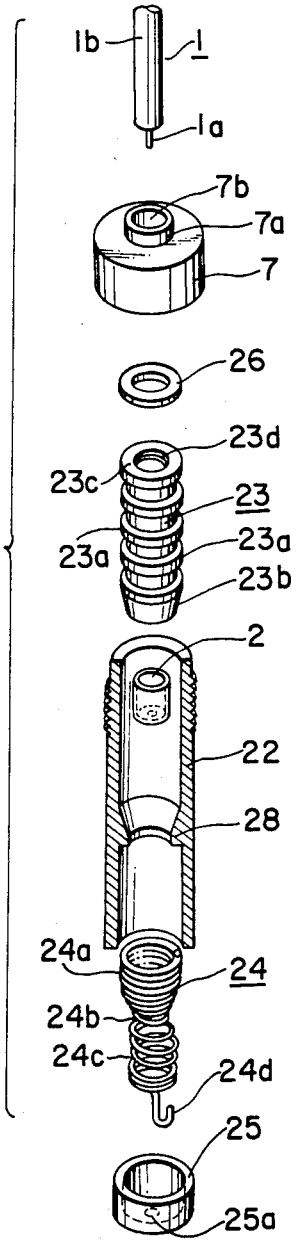

As shown in FIGS. 5 and 6, the cap 7 is provided with a lip or collar 7*a* in which an aperture 7*b* (FIG. 6) is formed, whose diameter is slightly greater than the outer diameter of the cable 1. The washer 26 has an inner diameter greater than the outer diameter of the cable 1. The packing 23 is imparted with resiliency (i.e. rubber) and has an outer wall formed with a plurality of annular ridges (or ribs) 23*a*. Further, the packing 23 has an end portion having a tapered portion 23*b* and end portion 23*c* having a channel 23*d* formed therein. The inner diamter of the packing 23 is slightly smaller than the outer diameter of the cable 1, whereby the packing and the cable 1 are resiliently bought into close or intimate contact with each other. The outer diameter of the ridges 23*a* is slightly greater than the inner diameter of the insulating tube 22. The bonding agent is injected in the channel 23*d* formed in the packing 23, whereby the packing 23 and the cable 1 are bonded together by the adhesive. The length of the packing 23, as measured from the tapered end portion 23*b* to end portion 23*c*, is selected to be slightly longer than the length of the insulating tube 22 as measured from the tapered portion 28 to the end portion 22*a*. After packing 23 has been pushed within the tube 22, the former can further be compressed and pushed into the tube 22 completely by rotating the cap 7. In the compressed state of the packing 23, the ridges 23*a* are brought into close or intimate contact with the inner wall of the insulating tube 22. As shown most clearly in FIG. 6, the coiled contact 24 includes a portion 24*a* of a substantially cylindrical form, a portion 24*b* coiled with a taper, a portion 24*c* which is contiguous to the portion 24*b* and realized in the form of a coiled spring, and a terminal portion 24*d* which is contiguous to the portion 24*c*. The terminal portion 24*d* is formed in a hook-like configuration. The portion 24*a* of the coiled contact 24 has an outer diameter smaller than the inner diameter of the insulating tube 22. The contact 2 is inserted within the portion 24*a* of the coiled contact 24. Accordingly, the outer diameter of the contact 2 is smaller than the inner diameter of the portion 24*a*. The portion 24*b* is electrically contacted to the contact 2. The terminal portion 24*d* is inserted through the aperture 25*a* formed in the stopper 25 and bonded to the latter by, for example, solder, whereby the portions 24*a*, 24*b* and 24*c* are supported by the stopper 25.

When the cable 1, the contact 2 and the packing 23 are inserted in a unit in the interior of the tube 22, the contact 2 is forcibly placed within the interior of the coiled contact 24, whereby the contact 2 and the coiled contact 24 are electrically connected to each other. Further, when the cable 1, the contact 2 and the packing 23 are inserted within the tube 22, the coiled contact 24 is pressed by the contact 2, resulting in that the portion 24*c* of the coiled contact 24 is compressed, whereby the tapered portion 23*b* of the packing 23 is caused to abut on the tapered portion 28 of the insulating tube 22. By rotating the cap 7 fitted onto the tube 22, the packing 23 is compressed by the cap 7, whereby the ridges 23*a* are closely and intimately brought into contact with the inner wall of the insulating tube 22. Upon compression of the packing 23, the portion 24*c* of the coiled contact 24 is further compressed by the contact 2. In this manner, positive electrical connection between the contact 2 and the coiled contact 24 is further enhanced. Through the electric connection between the contact 2 and the coiled contact 24, the conductor 1*a* of the cable 1 is electrically connected to the conductor 18.

Upon compression of the packing 23, the tapered portion 23*b* is also caused to be brought into close and initimate contact with the tapered portion 28. So long as the ridges 23*a* are in the close or intimate contact with the inner wall of the tube 22, aqueous vapor is prevented from flowing into the interior beyond the ridges 23. Additionally, so long as the tapered portion 23*b* remains in intimate contact with the tapered portion 28, aqueous vapor can not invade beyond the tapered portion 23*b*. Since the cable 1 and the packing 23 are in resilient intimate contact with each other, aqueous vapor is prevented from flowing between them. Furthermore, because the contact 2 and coiled contact 24 are brought into resilient contact with each other, any possibility of the contact between the coiled contact 24 and the contact 2 being loosened due to vibration applied to the connector apparatus can be positively avoided.

As will be appreciated from the foregoing description, the positive electrical connection of a high tension cable can be accomplished by using the connector apparatus according to the present invention with the possibility of occurrence of electric discharge being effectively reduced.

I claim:

1. A connector apparatus for connecting a high tension cable having an elongated conductor through which a current flows under a high voltage, an insulating coat disposed around said conductor so as to enclose said conductor, and an electric contact connected to an end portion of said conductor, said connector apparatus comprising:

(a) a tubular isolating wall made of an insulating resin material and having a predetermined inner diameter and a tapered rim formed in the inner surface thereof, said tubular isolating wall having an exterior surface formed with a male thread;

(b) a cylindrically shaped packing made of a resilient insulating resin material having an aperture of a diameter slightly smaller than the diameter of said high tension cable which is inserted through said aperture, said packing having an outer wall formed with a plurality of ring-like ridges each having a diameter slightly greater than the inner diameter of said tubular isolating wall, said packing having a tapered portion formed at one end thereof, said tapered portion being brought into contact with said rim of said tubular isolating wall upon insertion of said packing within said tubular isolating wall, a length of said packing, as measured from the tapered portion to the other end portion being slightly longer than a length of said tubular isolating wall as measured from said tapered rim to the end portion of said tubular isolating wall;

(c) a coil-like contact formed of a metal wire, said coil-like contact including:

(1) a cylindrical portion having an outer diameter smaller than the inner diameter of said tubular isolating wall and having an inner diameter greater than the outer diameter of said electrical contact connected to the end portion of said conductor, said electric contact of said high tension cable being inserted in said cylindrical portion so that said cylindrical portion is electrically connected to the conductor of said high tension cable, (2) a resilient coiled spring portion being contigious to said cylindrical portion, (3) a terminal portion contigious to said coiled spring portion and constituting an electric terminal for the high tension current;

(d) supporting means holding said coil-like contact for supporting said coil-like contact against said tubular isolating wall; and (e) a cap of an insulating resin, said cap having an inner diameter slightly greater than the outer diameter of said tubular isolating wall and having an aperture through which said high tension cable extends, and an inner wall formed with a female thread, said cap being fitted onto said tubular isolating wall and being threadably engageable with said tubular isolating wall, an inner end face of said cap urged against an end face of the other end portion of said packing such that, upon rotation of said cap, said packing is reduced in axial length to become substantially equal to said length of said tubular isolating wall.

2. An electrical connector apparatus according to claim 1, wherein said packing is provided with a channel at an end portion thereof, said channel enclosing said high tension cable in the state in which said high tension cable is inserted through said channel of said packing, said packing and said high tension cable are bonded to each other by filling said channel with a bonding agent.

* * * * *